US005992763A

United States Patent [19]

Smith et al.

[11] Patent Number: 5,992,763

[45] **Date of Patent: *Nov. 30, 1999**

[54] NOZZLE AND METHOD FOR ENHANCING FLUID ENTRAINMENT

[75] Inventors: Stephen K. Smith; N. Roland Dove; J. Edward Akin, all of Houston, Tex.

[73] Assignee: Vortexx Group Incorporated

[ * ] Notice: This patent is subject to a terminal disclaimer.

[21] Appl. No.: 08/906,868

[22] Filed: Aug. 6, 1997

[51] Int. Cl.[6] ..... B05B 7/04; E21B 10/60

[52] U.S. Cl. ..... 239/428.5; 239/418; 239/433; 239/434.5; 239/589; 239/DIG. 8; 175/393; 175/340; 417/198

[58] Field of Search ..... 239/418, 543, 239/423, 433, 434.5, 589, 428.5, DIG. 8, DIG. 21, DIG. 22; 417/179, 196, 198; 175/340, 393

[56] References Cited

U.S. PATENT DOCUMENTS

| | | | |
|---|---|---|---|
| 1,388,490 | 8/1921 | Surman . | |
| 1,754,671 | 4/1930 | Dahl . | |
| 1,833,477 | 11/1931 | Tomanek . | |
| 2,365,941 | 12/1944 | Crake | 255/61 |
| 2,657,024 | 10/1953 | Reinecke | 239/428.5 |
| 2,903,239 | 9/1959 | Standridge | 255/6.1 |
| 3,358,783 | 12/1967 | Raynal et al. | 175/393 |
| 3,414,070 | 12/1968 | Pekarek | 175/393 |
| 3,528,704 | 9/1970 | Johnson, Jr. | 299/14 |
| 3,548,959 | 12/1970 | Hasiba | 175/393 |
| 3,713,699 | 1/1973 | Johnson, Jr. | 299/14 |
| 3,838,742 | 10/1974 | Juvkam-Wold | 175/393 |
| 4,055,300 | 10/1977 | Binoche | 239/418 X |
| 4,184,806 | 1/1980 | Prinz | 417/160 |
| 4,262,757 | 4/1981 | Johnson, Jr. | 175/67 |
| 4,323,130 | 4/1982 | Dennis | 175/329 |
| 4,378,853 | 4/1983 | Chia et al. | 175/340 |
| 4,391,339 | 7/1983 | Johnson, Jr. | 175/393 |
| 4,436,166 | 3/1984 | Hayatdavoudi et al. | 175/65 |
| 4,512,420 | 4/1985 | Hayatdavoudi et al. | 175/67 |
| 4,515,227 | 5/1985 | Cerkovnik | 175/65 |
| 4,519,423 | 5/1985 | Ho et al. | 137/88 |
| 4,533,005 | 8/1985 | Morris | 175/393 |
| 4,555,059 | 11/1985 | Collins et al. | 239/425 |
| 4,640,374 | 2/1987 | Dennis | 175/393 |
| 4,687,066 | 8/1987 | Evans | 175/340 |
| 4,731,887 | 3/1988 | Henkin et al. | 4/541 |
| 4,768,532 | 9/1988 | Johnson | 134/111 |
| 4,809,381 | 3/1989 | Brandenburger et al. | 83/177 |
| 4,957,242 | 9/1990 | Schadow et al. | 239/590 |
| 5,025,875 | 6/1991 | Witt | 175/393 |
| 5,048,445 | 9/1991 | Lever et al. | 114/222 |
| 5,083,386 | 1/1992 | Sloan | 37/57 |
| 5,133,503 | 7/1992 | Giordano et al. | 239/532 |
| 5,295,425 | 3/1994 | Hediger | 832/177 |
| 5,382,003 | 1/1995 | Sankaranarayanan et al. | 266/230 |
| 5,494,124 | 2/1996 | Dove et al. | 175/424 |
| 5,518,395 | 5/1996 | Maughan | 431/8 |
| 5,632,349 | 5/1997 | Dove et al. | 175/393 |
| 5,676,214 | 10/1997 | Pearce et al. | 175/340 |

*Primary Examiner*—Andres Kashnikow
*Assistant Examiner*—Robin O. Evans
*Attorney, Agent, or Firm*—Browning Bushman

[57] ABSTRACT

A nozzle 10 and method for enhancing entrainment of a fluid near a face 18 of the nozzle 10, where the nozzle 10 includes a nozzle body 18 defining a nozzle opening 14 for ejecting a fluid therethrough. At least one indentation 20 is formed in the nozzle face 18 adjacent to, but spaced from, the nozzle opening 14 and includes a contoured surface 22 defined by first and second side surfaces 24 and 26 that converge toward the nozzle opening 14 to form a leading edge 28 closest to the nozzle opening 14. The imaginary extension 30 of at least a portion of the contoured surface 22 converges at a focal point 32 distal the nozzle face 18, defining an entrainment path. The focal point 32 is closer to an imaginary projection 34 of the nozzle opening 14, extending outwardly from and normal to the nozzle face 18, than the leading edge 20 is to the nozzle opening 14. Thus, fluid near the nozzle face in the indentation 20 is entrained into the entrainment path 30 and fluid ejected through the nozzle opening 14.

28 Claims, 4 Drawing Sheets

FIG. 3
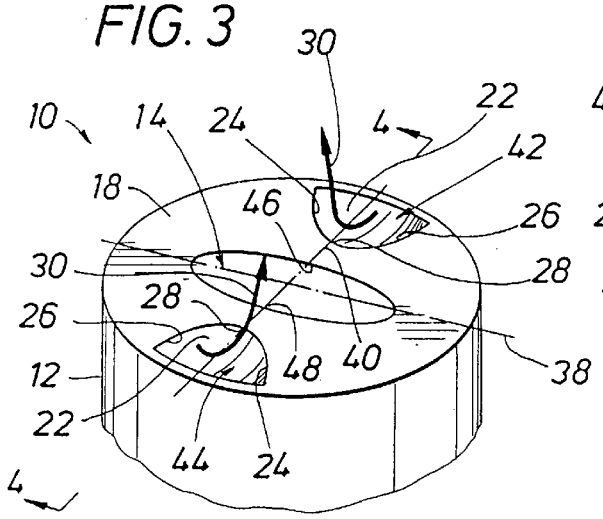
FIG. 4
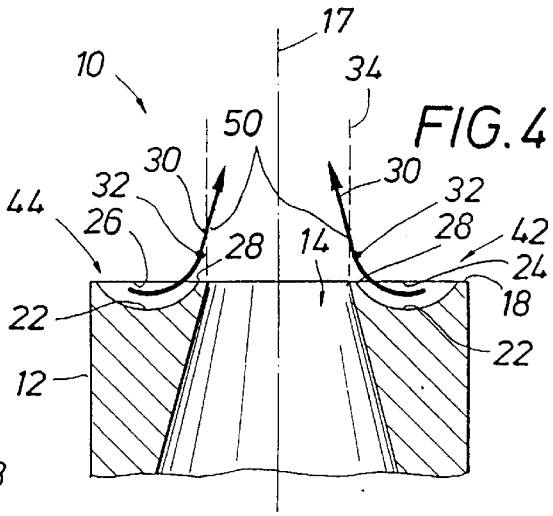
FIG. 1
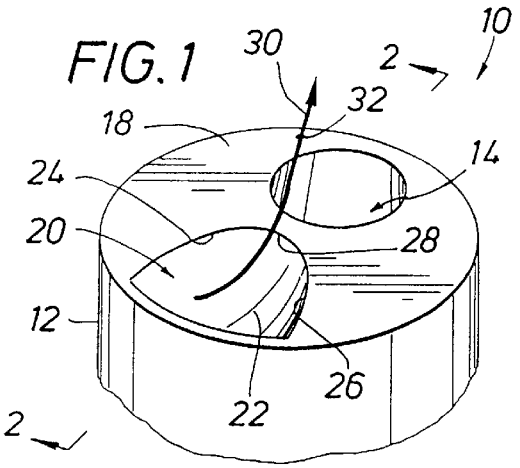
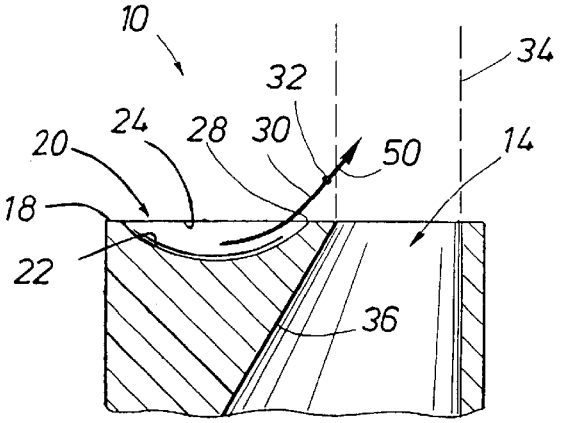
FIG. 2
FIG. 5
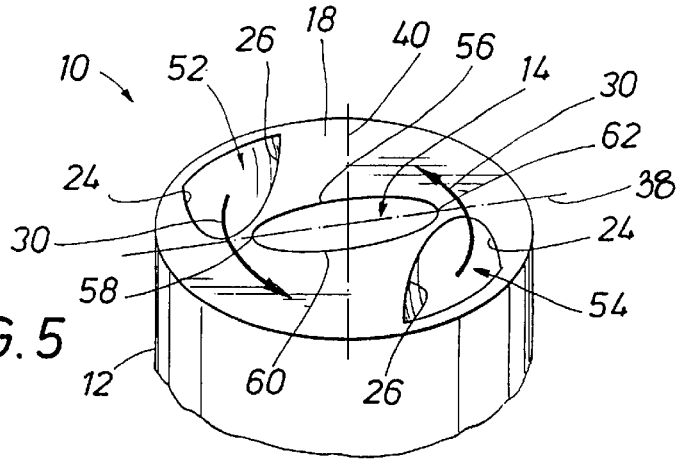

NOZZLE AND METHOD FOR ENHANCING FLUID ENTRAINMENT

FIELD OF THE INVENTION

This invention relates to a nozzle with one or more indentations in a face of the nozzle and method for entrainment of a fluid near the nozzle face into the desired path of fluid ejected from an opening in the nozzle.

BACKGROUND OF THE INVENTION

Nozzles are used in a variety of applications and for several applications the performance of the nozzle is related to the amount of fluid entrained into the fluid path being ejected from the nozzle. Typically, nozzle designs incorporating entrainment properties are utilized in any fluid medium where fluid turbulence exists around the nozzles exterior surface and entrainment of the fluid surrounding the nozzle into the ejected fluid path is desired.

For purposes of clarity, fluid, as used herein, is intended to encompass any medium which may be emitted through a nozzle opening including, but not limited to gases, foams, mists and the like.

Nozzles requiring entrainment properties are often used in subterranean drilling applications for hydrocarbons due to the necessity to remove cuttings from the drilling fluid that inhibit the drill bit's rate of penetration. Nozzles are typically incorporated into a variety of different drill bits. For example, rotary drill bits are used in the drilling of deep holes, such as oil wells. Some are polycrystalline diamond compact ("PDC") bits with segmented rows or sectors of diamond hardened cutters; others are rotary cone drill bits, rock bits and/or fixed cutter bits. In each bit, however, the bit body upper end is threaded for attachment to the lower end of the drill line made of pipe. In normal drilling operations, the drill line pipe is rotated thus, forcing the rock bit into the earth. The sectors of teeth in a PDC bit or the cones in a rotary cone bit travel about the centerline of the drill bit and the rock cutters dig into the geological formation to fail scrape, crush and/or fracture it. The bit body also serves the function of a terminal pipe fitting to control and route drilling fluid from inside the drill line pipe out through a plurality of mud nozzles housed in the drill bit and up the annulus between the drill column and the wellbore.

Vertical channels, sometimes called junk slots, are formed between the exterior wall of the PDC bit body adjacent the nozzle locations and the borehole wall to facilitate the flow of fluid and entrained cuttings from the drilling zone. Inadequate removal of cuttings from between the cutter teeth in the drill bit and the formation rock causes more substantial rock chips on the hole bottom to be ground to a paste by the bit. For example, a cube of particle 200 microns on each side, if allowed to remain in the borehole, could be ground into 8 million 1 micron cubes. These cuttings, called "drilled solids" approach colloidal size and hydrate in the fluid, increasing fluid viscosity at the bit, also referred to as "plastic viscosity." As the plastic viscosity of the mud increases, the drilling rate decreases because the mud must get under a chip quickly so the bit cutters do not grind the chip instead of formation rock. If viscosity is high, the fluid cannot get under the chip rapidly and efficiently flush cuttings from the hole bottom. This impedes the penetration of the rock bit into the geological formation, abrasively wears the cutters, causes excessive drag and can produce well bore damage. Moreover, if the drilled solids are left in the mud, and viscosity of the mud in the annulus increases, resulting in thick filter cakes that reduce the area for moving mud up the annulus. This may lead to lost circulation, formation damage and stuck drill pipe.

The prior art has recognized that the pressure differential between the drilling fluid and the formation fluid effects the removal of cuttings from the borehole bottom and reduces the rate of penetration. Various techniques have been employed to counteract the foregoing effects in order to cause the fluid emerging from the bit nozzles to clean the bottom of the hole. One technique forces the fluid into the hole bottom as hard as possible, commonly referred to as "optimizing hydraulic impact." Another technique causes the fluid to expend as much power across the nozzle as possible, referred to as "optimizing hydraulic horsepower."

The conventional mud nozzle in a drilling bit is usually an axially symmetrical circular orifice. Generally, the stream expands out substantially conically after leaving the nozzle. In a PDC bit, the jets are typically spaced in front of the leading edge of a row or sector of teeth. In a rotary cone bit, a nozzle is provided for each rotary rock cutter and is positioned in the bit to direct a high velocity of fluid downward between the cutters and against the well bore wall. The positioning of the nozzle will thus, wash the face of the cutter cones and flush cuttings through to the annulus.

High pressure nozzles for injecting drilling fluid into the borehole have not satisfactorily provided the desired efficient removal of rock chips through to the annulus. It is also well known that turbulent pressure fluctuations have been found to provide lifting forces sufficient to overcome rock chip hold down to remove rock debris from the hole bottom. This technique uses the rock bit itself and facilitates drilling of the wellbore. Substantial effort has been directed to the foregoing problems of cutting removal and bit balling.

For example, Hayatdavoudi in U.S. Pat. Nos. 4,436,166 and 4,512,420, includes a nozzle and a drilling sub above the drilling bit. The nozzle is oriented to eject drilling fluid from the sub into the annulus above the bit with a horizontal velocity component tangential to the annulus to impart a swirling motion to the drilling fluid in the annulus, and create a vortex which attempts to pull the cuttings radially outward from the cutter formation interface and upward through the annulus.

U.S. Pat. No. 4,687,066 to Evans is directed to the use of bit nozzles having openings convergently skewed relative to the bit center line and to each other, causing ejected drilling fluid to spin downwardly in a vortex and sweep formation cuttings from the cutting face up through the annulus.

Johnson in U.S. Pat. Nos. 3,528,704 and 3,713,699, teaches the use of cavitating nozzles as cutting tools against the rock. A fluid stream is pulsated at a high frequency with enough energy to physically vaporize the fluid in a low pressure phase of the vibratory wave. The vapor bubbles produced implode in the high pressure phase of the same waves and, very close to the rock surface, cause particles of the rock to erode away in tension. Later variations are described in U.S. Pat. Nos. 4,262,757 and 4,391,339 also to Johnson, and in 4,378,853 to Chia.

U.S. Pat. No. 4,533,005 to Morris relates to a nozzle for use on a rotary drill bit in which the orientation of the jet can be adjusted after the nozzle has been installed. The jet opening is arranged and configured such that the orientation of the fluid jet emitted therefrom is changed in response to rotation of the nozzle body about its longitudinal axis.

U.S. Pat. No. 4,519,423 to Ho et al is an apparatus for mixing fluids that includes a fluid conductive means terminating in at least one non-circular orifice for emitting a jet of first fluid along a path in a pre-selected direction and a means for providing a second fluid at a location downstream of the orifice for mixing with the first fluid. In a preferred embodiment, the orifice is elliptical to generate a jet of non-circular cross-section and relatively low aspect ratio. Thus, Ho primarily deals with various jet orifices for emitting a first fluid to enhance mixing with a second fluid downstream from the orifice.

U.S. Pat. No. 4,957,242 to Schadow et al is also directed to a fluid mixing device in which a jet of first fluid is passed through a nozzle having a conical inlet section in a non-circular, elongated, exit section. The jet of first fluid mixes with the second fluid located downstream of the device. The interaction of the conical and elongated sections produces axial rotation in the first fluid causing it to mix with the second fluid.

It has also been proven that nozzles with non-axisymmetric interior bores can increase the amount of fluid entrained, improving the rate of penetration. For example, Dove et al in U.S. Pat. Nos. 5,494,124 and 5,632,349 teaches the use of a drill bit having a uniquely constructed interior bore surface for maximizing the rate of penetration of the drill bit, eliminating hydrostatic hold down forces and effectively sweeping the cuttings and formation fragments into the annulus.

It is apparent from the above that a need exists in the art to improve entrainment of the drilling fluid surrounding the nozzle in order to efficiently remove formation cuttings and other debris thus, improving the rate of drill bit penetration. Additionally, there is always a need to increase bottom hole cleaning by entrainment of the drilling fluid into a desired path. The prior art fails to meet these needs in a cost effective, novel, approach.

SUMMARY OF THE INVENTION

It is a general object of the present invention to provide a nozzle and method for entraining a fluid near the face of the nozzle into a desired path of a pressurized fluid ejected through an opening in the nozzle face.

It is therefore, a principle object of the present invention to provide a nozzle with at least one indentation in the face of the nozzle whereby the entrainment of fluid in the indentation is enhanced by the ejection of a pressurized fluid through an opening in the nozzle face.

It is another object of the present invention to provide a nozzle that will increase the rate of drill bit penetration by entraining a fluid near the face of the nozzle into a desired path of a pressurized fluid ejected through an opening in the nozzle face.

It is yet another object of the present invention to provide a nozzle that will increase bottom hole cleaning in the bottom of the borehole by entrainment of fluid near the nozzle face into the desired path of pressurized fluid being ejected through an opening in the nozzle face.

It is yet another object of the present invention to provide a nozzle that improves differential values for pressure and velocity.

It is still another object of the present invention to provide a method for enhancing entrainment of fluid near the face of a nozzle into a desired path by the ejection of pressurized fluid through an opening in the nozzle face.

It is a principal feature of the present invention to provide a nozzle having one or more indentations in the nozzle face that define primary or secondary entrainment paths.

It is another feature of the present invention to provide a nozzle with at least one indentation in the nozzle face that also penetrates an upper portion of a sidewall of the nozzle body for enhancing entrainment of the fluid in the indentation.

It is yet another feature of the present invention to provide a nozzle with at least one indentation in the nozzle face that is aligned with a contoured internal surface of the nozzle body.

The above and various other objects and advantages of the present invention will become apparent from the following summary, detailed description of the preferred embodiments, drawings and claims.

Accordingly, the foregoing objectives are achieved by the nozzle of the present invention which includes a body defining a nozzle opening for ejecting a fluid therethrough and a nozzle face in surrounding relationship to the nozzle opening. At least one indentation is formed in the nozzle face adjacent to, but may be spaced from, the nozzle opening and includes a contoured surface defined by first and second side surfaces that converge toward the nozzle opening to form a leading edge closest to the nozzle opening. Preferably, the contoured surface is substantially concave, but may be planar. The imaginary extension of at least a portion of the contoured surface converges at a focal point distal the nozzle face, defining an entrainment path. The focal point is closer to an imaginary projection of the nozzle opening extending outwardly from and normal to the nozzle face than the leading edge is to the nozzle opening. The contoured surface may also be aligned with a contoured internal surface of the body for optimal entrainment of the fluid in the indentation by the fluid ejected through the nozzle opening. Thus, fluid in the indentation is entrained into the fluid ejected through the nozzle opening.

In a one embodiment, the nozzle opening includes at least one major axis and at least one minor axis. The imaginary extension of the substantially concave surface of each indentation also may define a primary entrainment path that is positioned closer to the minor axis than the major axis. Alternatively, the imaginary extension of the substantially concave surface of each indentation may define a secondary entrainment path that is positioned closer to the major axis than the minor axis.

A first and second indentation are formed in the nozzle face adjacent to, but spaced from, the nozzle opening. Each first and second indentation has a substantially concave surface defined by first and second side surfaces converging to form a leading edge closest to the nozzle opening. The imaginary extension of at least a portion of each contoured surface converges at a focal point distal the nozzle face defining an entrainment path. Each focal point is closer to an imaginary projection of the nozzle opening extending outwardly from and normal to the nozzle face than the leading edge is to the nozzle opening.

The first and second side surfaces of the first indentation converge toward a first end of a minor axis of the nozzle opening, and the first and second side surfaces of the second indentation converge toward a second end of the minor axis, the imaginary extension of at least a portion of each contoured surface for each first and second indentation defining a primary entrainment path that becomes normal to the nozzle face. Alternatively, the first and second side surfaces of the first indentation converge from a first longitudinal side of the nozzle opening toward a first end of the major axis of the nozzle opening, and the first and second side surfaces of the second indentation converge from a second longitudinal side of the nozzle opening toward a second end of the major axis, the imaginary extension of at least a portion of each contoured surface for each first and second indentation defining a spiral entrainment path that becomes normal to the nozzle face. Consequently, numerous other shaped entrainment paths may be created by varying the position and number of indentations relative to the nozzle's internally contoured surface and the nozzle opening's major and minor axes.

The substantially concave surface of each first and second indentation may also extend through an upper portion of a side wall of the nozzle body and includes third and fourth side surfaces that converge away from the nozzle face to form another leading edge below the nozzle face. The another leading edge of each first and second indentation may be positioned substantially below the nozzle face and closer to a distal end of the nozzle body opposite the nozzle face, than the nozzle face. The nozzle body may be rotatably moveable within a housing or drill bit for aligning the contoured surface of the nozzle relative to the housing and releasably securing the nozzle to a source of pressurized fluid.

In another embodiment, a plurality of nozzle openings and indentations are formed in the nozzle face. Each nozzle opening is positioned between two indentations such that an imaginary extension of at least a portion of each contoured surface of each indentation defines an entrainment path for each adjacent nozzle opening. Each nozzle opening is preferably equidistantly spaced apart in alternating relationship with each indentation. The nozzle openings and indentations are concentrically disposed in the nozzle face.

In a preferred method for enhanced entrainment of a fluid near the nozzle face, a nozzle is formed having a body defining a nozzle opening and a nozzle face in surrounding relationship to the nozzle opening. At least one indentation is formed in the nozzle face adjacent to, but may be spaced from, the nozzle opening. Each indentation includes a contoured surface that is preferably substantially concave, but may be planar. Each substantially concave surface is defined by first and second side surfaces that converge toward the nozzle opening to form a leading edge closest to the nozzle opening. The imaginary extension of at least a portion of the substantially concave surface converges at a focal point distal the nozzle face, defining an entrainment path. The focal point is closer to an imaginary projection of the nozzle opening extending outwardly from and normal to the nozzle face than the leading edge is to the nozzle opening.

A distal end of the nozzle body opposite the nozzle face is then releasably connected to a source of pressurized fluid and positioned in the fluid whereby ejecting the pressurized fluid through the nozzle opening into the fluid entrains the fluid near the nozzle face in the indentation into the path of pressurized fluid being ejected through the nozzle opening. The substantially concave surface may also be aligned with a contoured internal surface of the body for entrainment of the fluid in the indentation by the fluid ejected through the nozzle opening.

A plurality of indentations may be formed in the nozzle face adjacent to, but spaced from, the nozzle opening. Each indentation may include a substantially concave surface defined by first and second side surfaces converging to form a leading edge closest to the nozzle opening. The imaginary extension of at least a portion of each contoured surface converges at a focal point distal the nozzle face defining an entrainment path. Each focal point is closer to an imaginary projection of the nozzle opening, extending outwardly from and normal to the nozzle face than the leading edge is to the nozzle opening.

Additionally, a plurality of nozzle openings may be formed in the nozzle face. Each nozzle opening being positioned between two indentations such that each indentation defines an entrainment path for each adjacent nozzle opening. Each nozzle opening is preferably equidistantly spaced apart in alternating relationship with each indentation. The nozzle openings and indentations are concentrically disposed in the nozzle face.

Various other applications may utilize the nozzle and method for enhancing fluid entrainment as described hereinabove, such as for use in fuel injection systems or combustion engines; sand/water blasting nozzles; and other mixing applications.

BRIEF DESCRIPTION OF THE DRAWINGS

FIG. 1 is a partial perspective view of one embodiment of a nozzle showing one indentation positioned at a secondary location for entrainment adjacent the nozzle opening.

FIG. 2 is a cross-sectional side view of the nozzle embodiment depicted in FIG. 1 taken along lines 2—2.

FIG. 3 is a partial perspective view of another embodiment of the nozzle showing two indentations positioned at primary locations for entrainment adjacent opposite sides of the nozzle opening.

FIG. 4 is a cross-sectional side view of the nozzle embodiment depicted in FIG. 3 taken along lines 4—4.

FIG. 5 is a partial perspective view of another embodiment of the nozzle showing two indentations positioned on opposite sides of the nozzle opening and converging towards opposite ends of the nozzle opening that create a swirled entrainment path at two secondary locations for entrainment.

DETAILED DESCRIPTION OF PREFERRED EMBODIMENTS

Figure 6:
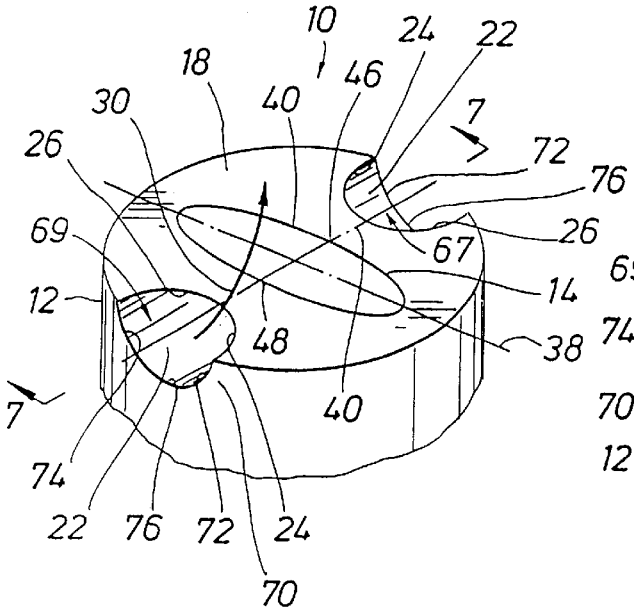
FIG. 6 is a partial perspective view of another embodiment of the nozzle showing two indentations positioned at primary locations for entrainment as shown in FIG. 3, but extending through a side wall of the nozzle for entrainment when a face of the nozzle extends above a housing for the nozzle.

With reference now to FIGS. 1 and 2, the nozzle 10 includes a body 12 defining a nozzle opening 14 for ejecting a fluid (not shown) therethrough and a nozzle face 18 in surrounding relationship to nozzle opening 14. The nozzle opening 14 is generally circular, however, may be formed to include any other shape having at least one major axis 38 and at least one minor axis 40 such as the elliptical nozzle opening 14 depicted in FIG. 3. The nozzle face 18 is generally planar and perpendicular to a longitudinal axis 17 of the nozzle opening 14 as shown in FIG. 4. However, the nozzle face 18 may be non-planar or non-perpendicular to the axis 17 of the nozzle opening 14.

Still referring to FIGS. 1 and 2, at least one indentation 20 is formed in the nozzle face 18 adjacent the nozzle opening 14 and includes a contoured surface 22 defined by first and second side surfaces 24 and 26 that converge toward the nozzle opening 14 to form a leading edge 28 closer to the nozzle opening 14 than any other edge of said first and second side surfaces 24 and 26. Alternatively, the indentation 20 may be formed in the nozzle face 18 immediately adjacent to, and not spaced from, the nozzle opening 14. The leading edge 28 closest to the nozzle opening 14 is formed by a linear or non-linear edge taken between the first and second side surfaces 24 and 26, and is positioned within a distance of an edge of the nozzle opening closest to said leading edge 28 that is not substantially greater than a distance from a center of the nozzle opening to the edge of the nozzle opening. The contoured surface 22 is preferably concave, however, may be planar.

The imaginary extension 30 of at least a portion of the contoured surface 22 converges at a focal point 32 distal the nozzle face 18, defining an entrainment path. The focal point 32 is closer to an imaginary projection 34 of the nozzle opening 14 extending outwardly from and normal to the nozzle face 18, than the leading edge 28 is to the nozzle opening 14. The imaginary extension or entrainment path 30 intersects the imaginary projection 34 of the nozzle opening 14 at 50.

The contoured surface 22 of the indentation 20 is disposed in the nozzle face 18 at a secondary location for entrainment and is aligned with a contoured internal surface 36 of the nozzle body 12, which is angled. A primary entrainment path is achieved by positioning the imaginary extension 30 of the contoured surface 22 closer to a major axis 38 than a minor axis 40 of the nozzle opening 14 as shown by the indentations 100 in FIG. 10. A secondary entrainment path is achieved by positioning the imaginary extension 30 of at least a portion of the contoured surface 22 closer to the minor axis 40 than the major axis 38 as shown by the indentations 102 in FIG. 10.

With reference now to FIGS. 3 and 4, another embodiment is shown for a nozzle 10 having a first and second indentation 42 and 44 in the nozzle face 18 adjacent to, but spaced from, the nozzle opening 14. Each first and second indentation 42 and 44 has a contoured surface 22 which is substantially concave and defined by first and second side surfaces 24 and 26 converging to form a leading edge 28 closest to the nozzle opening 14. The imaginary extension 30 of at least a portion of each contoured surface 22 converges at a focal point 32 distal the nozzle face 18. The imaginary extension 30 of at least a portion of the contoured surface 22 defines an entrainment path that intersects an imaginary projection 34 of the nozzle opening 14 at 50, causing the entrainment of fluid (not shown) in each first and second indentation 42 and 44 into the fluid (not shown) ejected through the nozzle opening 14.

The first and second side surfaces 24 and 26 of the first indentation 42 converge toward a first end 46 of the minor axis 40 of the nozzle opening 14, and the first and second side surfaces 24 and 26 of the second indentation 44, converge toward a second end 48 of the minor axis 40. Thus, the imaginary extension 30 of at least a portion of each contoured surface 22 for each first and second indentation 42 and 44 defines a primary entrainment path that becomes normal to the nozzle face 18 at 50.

Referring to FIG. 5, a spiral entrainment path that becomes normal to the nozzle face 18 may be formed by positioning the first and second side surfaces 24 and 26 of the first indentation 52 so that they converge from a first longitudinal side 56 of the nozzle opening 14 toward a first end 58 of the major axis 38 of the nozzle opening 14, and positioning the first and second side surfaces 24 and 26 of the second indentation 54 so that they converge from a second longitudinal side 60 of the nozzle opening 14 toward a second end 62 of the major axis 38. Numerous other shaped entrainment paths may be created by varying the position and number of indentations relative to the nozzles internally contoured surface and the nozzle opening major and minor axes.

Figure 7:
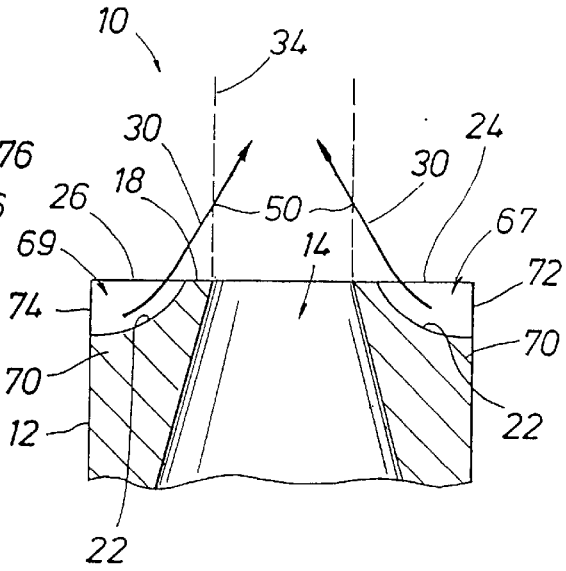
FIG. 7 is a cross-sectional side view of the nozzle embodiment depicted in FIG. 6 along lines 7—7.

Referring now to FIGS. 6 and 7, the contoured surface 22 of each first and second indentation 67 and 69 extends through an upper portion of a side wall 70 of the nozzle body 12 and includes third and fourth side surfaces 72 and 74 that converge away from the nozzle face 18 to form another leading edge 76 farther from the nozzle face 18 than any other edge of said third and fourth side surfaces 72 and 74. The nozzle body 12 may be rotatably moveable within a housing or drill bit (not shown) for aligning the contoured surface 22 of the nozzle 10 relative to the housing and releasably securing the nozzle 10 to a source of pressurized fluid. The extension of each concave surface 22 of each first and second indentation 67 and 69 through an upper portion of a side wall 70 of the nozzle body 12 facilitates entrainment of fluid (not shown) in each first and second indentation 67 and 69 when the nozzle face 18 extends above the surface of the housing or drill bit. A primary entrainment path that becomes normal to the nozzle face 18 at 50 is formed by positioning each first and second side surface 22 and 24 of the first indentation 67 so that they converge toward a first end 46 of the minor axis 40 of the nozzle opening 14, and positioning the first and second side surfaces 24 and 26 of the second indentation 69 so that they converge toward a second end 48 of the minor axis 40. Thus, the imaginary extension 30 of at least a portion of each contoured surface 22 for each first and second indentation 67 and 69 defines a primary entrainment path that becomes normal to the nozzle face 18 at 50 where the entrainment path intersects the imaginary projection 34 of the nozzle opening 14. The ejecting fluid (not shown) exiting the nozzle opening 14 initially exits the nozzle opening 14 normal to the nozzle face 18, however, will dissipate, expanding outwardly, downstream of the nozzle 10. Therefore, any fluid caught in the entrainment path 30 will react with the ejected fluid as the integrated fluid dissipates downstream of the nozzle 10.

Figure 12:
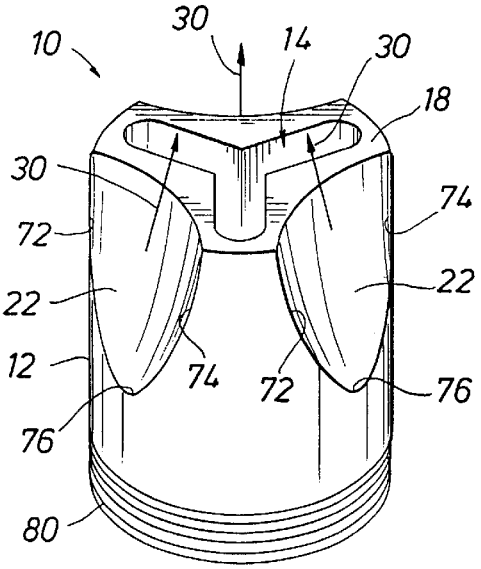
FIG. 12 is a perspective view of another embodiment of the nozzle with indentations formed axially through a side wall of the nozzle body at primary locations for entrainment.

In FIG. 12, the another leading edge 76 formed by the convergence of each third and fourth side surface 72 and 74 of each contoured surface 22, may be positioned substantially below the nozzle face 18 and closer to a distal end 80 of the nozzle body 12 opposite the nozzle face 18 when the nozzle 10 extends substantially beyond a housing or drill bit face (not shown).

Figure 13:
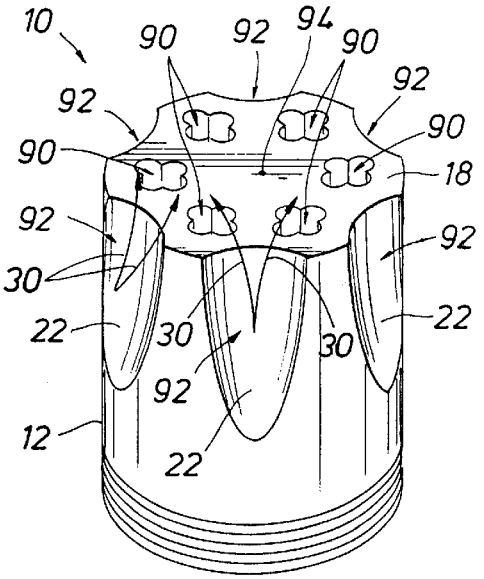
FIG. 13 is a perspective view of another embodiment of the nozzle with multiple nozzle openings and alternating indentations centrally disposed through the nozzle body.

In another nozzle embodiment depicted in FIG. 13, the nozzle 10 includes a nozzle body 12 having a plurality of nozzle openings 90 and indentations 92 formed in the nozzle face 18. Each nozzle opening 90 is positioned between two indentations 92, such that the imaginary extension 30 of at least a portion of each contoured surface 22 of each indentation 92 defines an entrainment path for each adjacent nozzle opening 90. Each nozzle opening 90 is preferably equidistantly spaced apart in alternating relationship with each indentation 92. The nozzle openings 90 and indentations 92 are concentrically disposed from a center 94 of the nozzle face 18. In another embodiment (not shown) the nozzle openings 90 and indentations 92 may be non-concentrically disposed from center 94 of the nozzle face 18; for example with openings 90 lying on an elliptical path.

Figure 8:
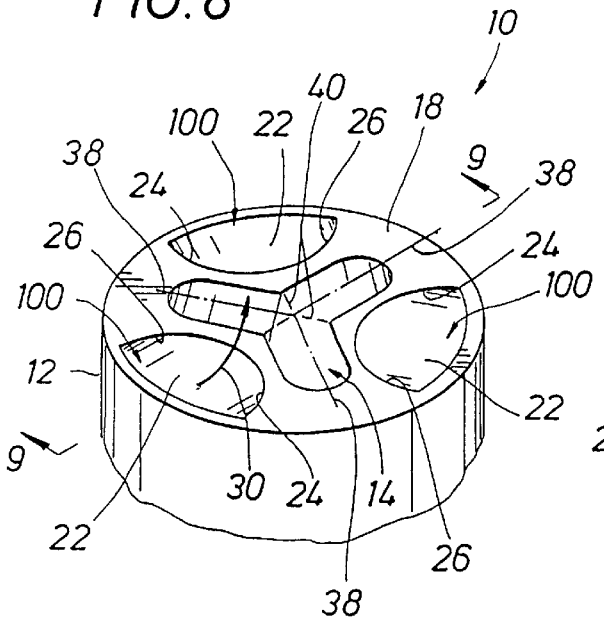
FIG. 8 is a partial perspective view of another embodiment of the nozzle showing three indentations positioned at primary locations for entrainment adjacent the nozzle opening.
Figure 9:
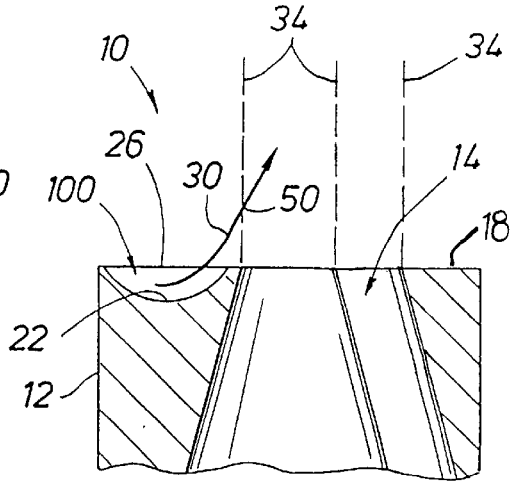
FIG. 9 is a cross-sectional side view of the nozzle embodiment depicted in FIG. 8 taken along lines 9—9.

FIGS. 8 and 9 demonstrate another embodiment of the nozzle 10 wherein a nozzle opening 14 is disposed through the nozzle body 12 having three major axes 38 and three minor axes 40. A plurality of equidistantly spaced indentations 100 are positioned in the nozzle face 18 and include a contoured surface 22 that is substantially concave and has first and second side surfaces 24 and 26 that converge closer to a minor axis 40 of the nozzle opening 14 than the major axis 38 of the nozzle opening 14. Consequently, a primary entrainment path is defined by the imaginary extension 30 of at least a portion of each contoured surface 22 of each indentation 100 that becomes normal to the nozzle face 18 at 50 where the entrainment path 30 intersects the imaginary projection 34 of the nozzle opening 14.

Figure 10:
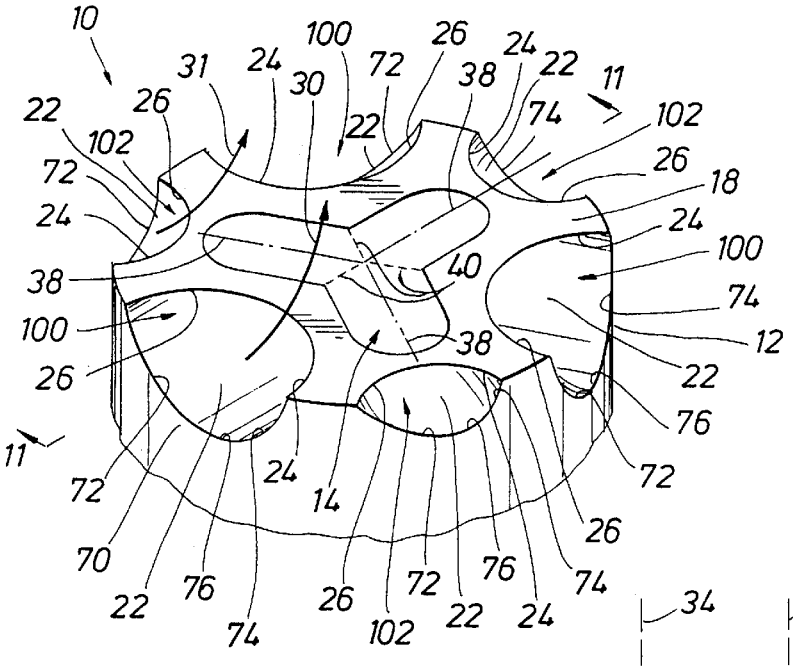
FIG. 10 is a partial perspective view of another embodiment of the nozzle showing three indentations positioned at primary locations for entrainment adjacent the nozzle opening and three indentations positioned at secondary locations for entrainment adjacent the nozzle opening, each indentation extends through a side wall of the nozzle for entrainment when a face of the nozzle extends above a housing for the nozzle.
Figure 11:
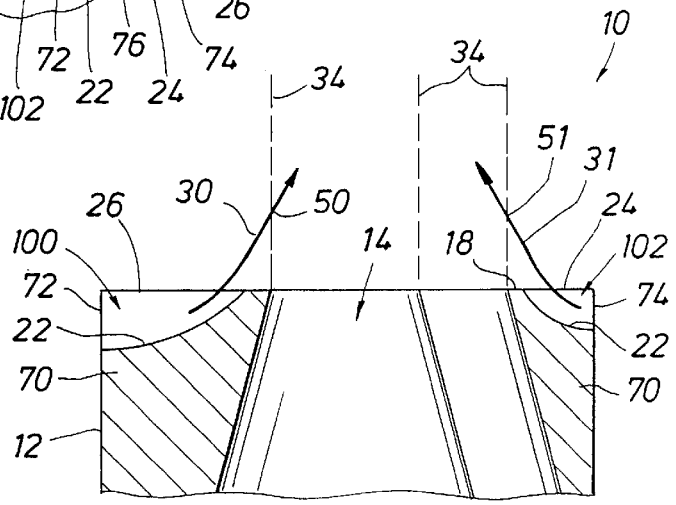
FIG. 11 is a cross-sectional side view of the nozzle embodiment depicted in FIG. 10 taken along lines 11—11.

FIGS. 10 and 11 depict another embodiment of the nozzle 10 similar to the embodiment depicted in FIGS. 8 and 9. Nozzle opening 14 is disposed through the nozzle body 12 having three major axes 38 and three minor axes 40. A plurality of equidistantly spaced indentations 100 are positioned in the nozzle face 18 and include a contoured surface 22 that is substantially concave and has first and second side surfaces 24 and 26 that converge closer to the minor axis 40 of the nozzle opening 14 than the major axis 38 of the nozzle opening 14. Consequently, a primary entrainment path is defined by the imaginary extension 30 of at least a portion of each contoured surface 22 of each indentation 100 that becomes normal to the nozzle face 18 at 50 where the entrainment path 30 intersects the imaginary projection 34 of the nozzle opening 14. The contoured surface 22 of each indentation 100 extends through an upper portion of a sidewall 70 of the nozzle body 12 and includes third and fourth side surfaces 72 and 74 that converge away from the nozzle face 18 to form another leading edge 76 below the nozzle face 18.

Similarly, a plurality of equidistantly spaced indentations 102 are positioned in the nozzle face 18 and include a contoured surface 22 that is substantially concave and has first and second side surfaces 24 and 26 that converge closer to a major axis 38 of the nozzle opening 14 than the minor axis 40 of a nozzle opening 14. Consequently, a secondary entrainment path is defined by the imaginary extension 31 of at least a portion of each contoured surface 22 of each indentation 102 that becomes normal to the nozzle face 18 at 51 where the entrainment path 31 intersects an imaginary projection 34 of the nozzle opening 14. Likewise, the contoured surface 22 of each indentation 102 extends through an upper portion of a sidewall 70 of the nozzle body 12 and includes third and fourth side surfaces 72 and 74 that converge away from the nozzle face 18 to form another leading edge 76 below the nozzle face 18.

Figure 14:
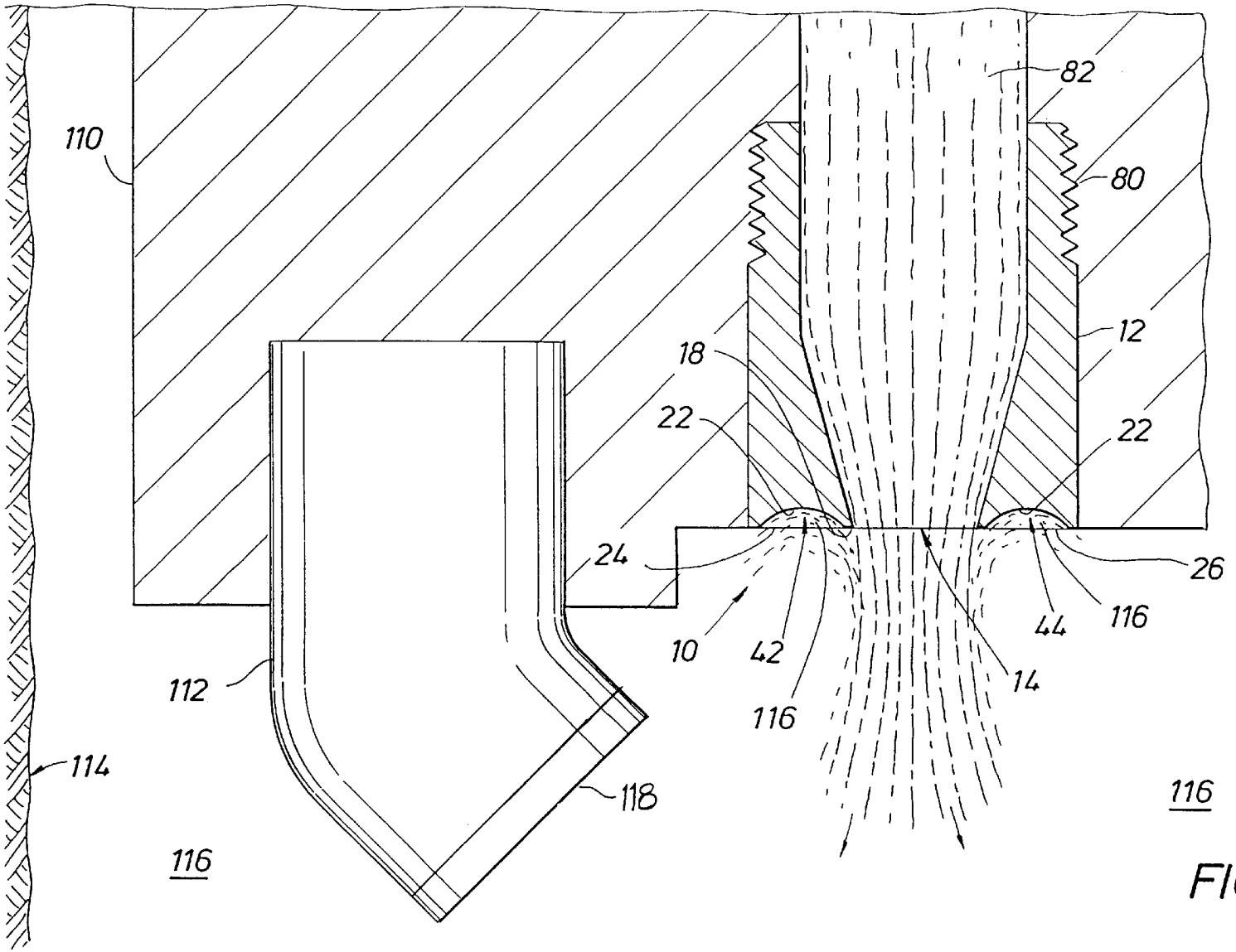
FIG. 14 is a cross-sectional side view of the nozzle shown in FIG. 3 housed within a drill bit and positioned for entraining bore hole drilling fluid.

In operation, a nozzle 10 is first formed having the characteristics of the nozzle 10 depicted in FIG. 4 and is then secured within a drill bit 110 adjacent a cutter 112 as shown in FIG. 14. A distal end 80 of the nozzle body 12 opposite the nozzle face 18 is releasably connected to a source of pressurized fluid 82. Once secured, the nozzle 10 and drill bit 110 are positioned in a borehole 114 to begin drilling operations. The pressurized (drilling) fluid 82 is ejected through the nozzle opening 14. The fluid 116 near the nozzle face 18 in each first and second indentation 42 and 44 is entrained into the path of pressurized fluid 82 being ejected through the nozzle opening 14. Thus, bottom hole cleaning of formation cuttings and other debris (not shown) removed by the cutter face 118 and caught between the cutter 112 and drill bit 112 adjacent the nozzle 10 is significantly improved by the entrainment process thus described. Accordingly, the fluid 116 surrounding the nozzle face 18 in each first and second indentation 42 and 44 is entrained into the ejected fluid 82 for increasing the rate of drill bit penetration and improving bottom hole cleaning by increasing turbulence and differential values for pressure and velocity. Typically, the pressurized fluid 82 and the fluid 116 surrounding the nozzle face 18 have similar properties, however, may comprise different fluids either in static or dynamic states.

Since the fluid 116 surrounding the nozzle face 18 in each first and second indentation 42 and 44 is integrated or mixed with the ejecting fluid 82 downstream of the nozzle 10, various other applications of the nozzle 10 may be useful where the integration or mixing of two fluids having different compositions or properties, such as air and gas, is desired.

Accordingly, various other modifications to the nozzle and method disclosed herein should be apparent from the above description of preferred embodiments. Although the invention has thus been described in detail for these embodiments, it should be understood that this explanation is for illustration only, and that the invention is not limited to these embodiments. Alternative components and methods will be apparent to those skilled in the art in view of this disclosure. Additional modifications are thus contemplated and may be made without departing from the spirit of the invention which is defined by the claims.

What is claimed is:

1. A nozzle comprising:

a body defining a nozzle opening for ejecting a fluid;

a nozzle face in surrounding relationship to the nozzle opening; and, at least one indentation in the nozzle face adjacent to said nozzle opening, the indentation having a contoured surface defined by first and second side surfaces converging to form a leading edge closer to said nozzle opening than any other edge of said first and second side surfaces, said leading edge being positioned within a distance of an edge of said nozzle opening closest to said leading edge that is not substantially greater than a distance from a center of the nozzle opening to said edge of the nozzle opening, an imaginary extension of at least a portion of said contoured surface defining an entrainment path distal the nozzle face, said entrainment path intersecting an imaginary projection of the nozzle opening extending outwardly from and normal to the nozzle face, whereby a fluid in said indentation is entrained into said ejecting fluid.

2. The nozzle as defined in claim 1, further comprising:

a plurality of indentations in the nozzle face adjacent to, but spaced from, said nozzle opening.

3. The nozzle as defined in claim 1, wherein said contoured surface extends through an upper portion of a side wall of the nozzle body and includes third and fourth side surfaces that converge away from said nozzle face to form another leading edge farther from the nozzle face than any other edge of said third and fourth side surfaces.

4. The nozzle as defined in claim 3, further comprising:

a distal end opposite the nozzle face, the another leading edge being positioned substantially below the nozzle face and closer to the distal end than the nozzle face.

5. The nozzle as defined in claim 4, wherein the distal end of the nozzle is releasably connected to a source of pressurized fluid.

6. The nozzle as defined in claim 1, wherein the contoured surface is aligned with a contoured internal surface of the body for optimal entrainment of the fluid in the indentation into the ejecting fluid.

7. The nozzle as defined in claim 1, wherein the nozzle opening includes at least one major axis and at least one minor axis.

8. The nozzle as defined in claim 7, wherein the imaginary extension of at least a portion of the contoured surface defines a primary entrainment path, the primary entrainment path being closer to the minor axis than the major axis.

9. The nozzle as defined in claim 7, wherein the imaginary extension of at least a portion of the contoured surface defines a secondary entrainment path, the secondary entrainment path being closer to the major axis than the minor axis.

10. The nozzle as defined in claim 1, further comprising:

a plurality of equidistantly spaced nozzle openings in alternating relationship with a plurality of equidistantly spaced indentations, said nozzle openings and said indentations being substantially concentric.

11. A nozzle comprising:

a body defining a nozzle opening for ejecting a fluid;

a nozzle face in surrounding relationship to the nozzle opening; and, at least one indentation in the nozzle face, the indentation having a substantially concave surface defined by first and second side surfaces converging to form a leading edge closer to said nozzle opening than any other edge of said first and second side surfaces, said leading edge being positioned within a distance of an edge of the nozzle opening closest to said leading edge that is not substantially greater than a distance from a center of the nozzle opening to said edge of the nozzle opening, an imaginary extension of at least a portion of said concave surface defining an entrainment path distal the nozzle face, said entrainment path intersecting an imaginary projection of the nozzle opening extending outwardly from and normal to the nozzle face, whereby a fluid in said indentation is entrained into said ejecting fluid.

12. The nozzle as defined in claim 11, further comprising:

a first and second indentation in the nozzle face, each indentation having a substantially concave surface defined by first and second side surfaces converging to form a leading edge closer to said nozzle opening than any other edge of said first and second surfaces, said leading edge being positioned within a distance of an edge of said nozzle opening closest to said leading edge that is not substantially greater than a distance from a center of the nozzle opening to said edge of the nozzle opening, an imaginary extension of at least a portion of said concave surface defining an entrainment path intersecting an imaginary projection of the nozzle opening extending outwardly from and normal to the nozzle face.

13. The nozzle as defined in claim 12, wherein said first and second side surfaces of said first indentation converge toward a first end of a minor axis of said nozzle opening, and said first and second side surfaces of said second indentation converge toward a second end of said minor axis, the imaginary extension of at least a portion of each contoured surface for each first and second indentation defining a primary entrainment path.

14. The nozzle as defined in claim 12, wherein said first and second side surfaces of said first indentation converge from a first longitudinal side of said nozzle opening toward a first end of a major axis of said nozzle opening, and said first and second side surfaces of said second indentation converge from a second longitudinal side of said nozzle opening toward a second end of said major axis, the imaginary extension of at least a portion of each contoured surface for each first and second indentation defining a spiral entrainment path.

15. A method for enhanced entrainment of a fluid near a nozzle face comprising:

forming a nozzle body including a nozzle opening and said nozzle face in surrounding relationship to the nozzle opening;

forming at least one indentation in the nozzle face adjacent to said nozzle opening, the indentation having a contoured surface defined by first and second side surfaces converging to form a leading edge closer to said nozzle opening than any other edge of said first and second side surfaces, said leading edge being positioned within a distance of an edge of said nozzle opening closest to said leading edge that is not substantially greater than a distance from a center of the nozzle opening to said edge of the nozzle opening, an imaginary extension of at least a portion of said contoured surface defining an entrainment path distal the nozzle face, said entrainment path intersecting an imaginary projection of the nozzle opening extending outwardly from and normal to the nozzle face;

releasably connecting a distal end of the nozzle body opposite the nozzle face to a source of pressurized fluid;

positioning the nozzle in said fluid; and ejecting said pressurized fluid through the nozzle opening into said fluid, whereby the fluid near the nozzle face in the indentation is entrained into the pressurized fluid ejected through the nozzle opening.

16. The method as defined in claim 15, further comprising:

forming a plurality of indentations in the nozzle face adjacent to, but spaced from, said nozzle opening.

17. The method as defined in claim 15, further comprising:

forming another leading edge below said nozzle face, said another leading edge being formed by third and fourth side surfaces that converge away from said nozzle face to form said another leading edge farther from the nozzle face than any other edge of said third and fourth side surfaces, said contoured surface extending through an upper portion of a side wall of the nozzle body.

18. The method as defined in claim 15, further comprising:

aligning the contoured surface with a contoured internal surface of the body for optimal entrainment of the fluid in the indentation by the ejecting fluid.

19. The method as defined in claim 15, further comprising:

forming a plurality of equidistantly spaced nozzle openings in alternating relationship with a plurality of equidistantly spaced indentations, said nozzle openings and said indentations being substantially concentric.

20. A nozzle comprising:

a body defining a nozzle opening for ejecting a fluid;

a nozzle face in surrounding relationship to the nozzle opening;

at least one indentation in the nozzle face adjacent to said nozzle opening, the indentation having a contoured surface aligned with a contoured internal surface of the body, said contoured surface defined by first and second side surfaces converging to form a leading edge closer to said nozzle opening than any other edge of said first and second side surfaces; and an imaginary extension of at least a portion of said contoured surface defining an entrainment path distal the nozzle face, said entrainment path intersecting an imaginary projection of the nozzle opening extending outwardly from and normal to the nozzle face, whereby a fluid in said indentation is entrained into said ejecting fluid.

21. The nozzle as defined in claim 20, wherein the contoured internal surface of the body is asymmetrical.

22. The nozzle as defined in claim 20, wherein the nozzle opening includes a major axis and a minor axis.

23. The nozzle as defined in claim 22, wherein the imaginary extension of at least a portion of the contoured surface defines a primary entrainment path, the primary entrainment path being positioned closer to the minor axis than the major axis.

24. The nozzle as defined in claim 22, wherein the imaginary extension of at least a portion of the contoured surface defines a secondary entrainment path, the secondary entrainment path being positioned closer to the major axis than the minor axis.

25. A method for enhanced entrainment of a fluid near a nozzle face comprising:

forming a nozzle body including a nozzle opening and said nozzle face in surrounding relationship to the nozzle opening;

forming a plurality of indentations in the nozzle face adjacent to said nozzle opening, each indentation having a contoured surface defined by first and second side surfaces converging to form a leading edge closer to said nozzle opening than any other edge of said first and second side surfaces, an imaginary extension of at least a portion of said contoured surface defining an entrainment path distal the nozzle face, said entrainment path intersecting an imaginary projection of the nozzle opening extending outwardly from and normal to the nozzle face;

releasably connecting a distal end of the nozzle body opposite the nozzle face to a source of pressurized fluid;

positioning the nozzle in said fluid; and ejecting said pressurized fluid through the nozzle opening into said fluid, whereby the fluid near the nozzle face in the indentation is entrained into the pressurized fluid ejected through the nozzle opening.

26. The method as defined in claim 25, further comprising:

forming another leading edge below the nozzle face, said another leading edge being formed by third and fourth side surfaces that converge away from said nozzle face to form said another leading edge farther from the nozzle face than any other edge of said third and fourth side surfaces, each contoured surface extending through an upper portion of a side wall of the nozzle body.

27. A method for enhanced entrainment of a fluid near a nozzle face comprising:

forming a nozzle body including a nozzle opening and said nozzle face in surrounding relationship to the nozzle opening;

forming at least one indentation in the nozzle face adjacent to said nozzle opening, the indentation having a contoured surface aligned with a contoured internal surface of the body, said contoured surface defined by first and second side surfaces converging to form a leading edge closer to said nozzle opening than any other edge of said first and second side surface, an imaginary extension of at least a portion of said contoured surface defining an entrainment path distal the nozzle face, said entrainment path intersecting an imaginary projection of the nozzle opening extending outwardly from and normal to the nozzle face;

releasably connecting a distal end of the nozzle body opposite the nozzle face to a source of pressurized fluid;

positioning the nozzle in said fluid; and ejecting said pressurized fluid through the nozzle opening into said fluid, whereby the fluid near the nozzle face in the indentation is entrained into the pressurized fluid ejected through the nozzle opening.

28. A nozzle for enhanced entrainment of a fluid surrounding a drill bit submerged in a well bore, the nozzle comprising:

a nozzle body having a nozzle opening for ejecting a pressurized fluid and a distal end for releasably connecting the nozzle body to the drill bit;

a nozzle face in surrounding relationship to the nozzle opening;

a plurality of indentations in the nozzle face adjacent to said nozzle opening, each indentation having a contoured surface defined by first and second side surfaces converging to form a leading edge closer to said nozzle opening than any other edge of said first and second side surface; and an imaginary extension of at least a portion of said contoured surface defining an entrainment path distal the nozzle face, said entrainment path intersecting an imaginary projection of the nozzle opening extending outwardly from and normal to the nozzle face, whereby the fluid surrounding the drill bit near the nozzle face in the indentation is entrained into the pressurized fluid ejected through the nozzle opening.

* * * * *